US012345020B2

(12) United States Patent
Oksman et al.

(10) Patent No.: US 12,345,020 B2
(45) Date of Patent: Jul. 1, 2025

(54) PERCUSSION DEVICE AND METHOD FOR CONTROLLING THE SAME

(71) Applicant: SANDVIK MINING AND CONSTRUCTION OY, Tampere (FI)

(72) Inventors: Mika Oksman, Lahti (FI); Jyrki Nissinen, Lahti (FI); Juhani Laine, Lahti (FI); Ossi Grohn, Lahti (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/276,796

(22) PCT Filed: Feb. 8, 2022

(86) PCT No.: PCT/EP2022/052952

§ 371 (c)(1),
(2) Date: Aug. 10, 2023

(87) PCT Pub. No.: WO2022/171595

PCT Pub. Date: Aug. 18, 2022

(65) Prior Publication Data

US 2024/0133158 A1 Apr. 25, 2024
US 2024/0229420 A9 Jul. 11, 2024

(30) Foreign Application Priority Data

Feb. 11, 2021 (EP) ..... 21156648

(51) Int. Cl.
*E02F 9/22* (2006.01)
*E02F 3/96* (2006.01)

(52) U.S. Cl.
CPC ..... *E02F 9/2228* (2013.01); *E02F 3/966* (2013.01); *E02F 9/2267* (2013.01)

(58) Field of Classification Search
CPC ..... E02F 9/2228; E02F 3/966; E02F 9/2267; E02F 5/305; E02F 9/2217; E02F 9/2271; E21B 1/26; E21B 4/14; E21B 1/38
USPC ..... 173/1–2, 184–189, 24–28
See application file for complete search history.

(56) References Cited

U.S. PATENT DOCUMENTS 2,943,603 A * 7/1960 Bassinger ..... E21B 4/14 173/132
3,642,076 A * 2/1972 Coyne ..... E21B 4/145 173/91
3,741,316 A * 6/1973 Alajouanine ..... B25D 9/12 173/200
3,805,896 A 4/1974 Bauer
(Continued)

FOREIGN PATENT DOCUMENTS

EP 2045492 A2 4/2009
EP 2718063 A1 4/2014
(Continued)

*Primary Examiner* — Robert F Long
(74) *Attorney, Agent, or Firm* — Corinne R. Gorski

(57) ABSTRACT

A hydraulic percussion device and method of controlling a working cycle of a percussion piston is provided. A rock breaking machine includes a percussion device provided with a reciprocating piston executing a working cycle. The operation is controlled by means of a control unit generating control signals for independently operable feed and discharge valves of a hydraulic system. The position of the piston is detected by a sensing device.

15 Claims, 5 Drawing Sheets

(56) References Cited

U.S. PATENT DOCUMENTS 3,821,992 A * 7/1974 Matsuo ..... B25D 9/08 60/591
3,842,917 A * 10/1974 Wisotsky ..... E02D 7/00 173/90
4,342,255 A * 8/1982 Watanabe ..... B06B 1/183 91/40
4,786,218 A * 11/1988 Feuser ..... B23F 23/1287 409/35
4,951,757 A * 8/1990 Hamada ..... B25D 9/12 91/277
5,174,387 A * 12/1992 Arndt ..... E02F 3/966 91/321
5,279,120 A * 1/1994 Sasaki ..... B25D 9/145 173/208
7,073,607 B2 * 7/2006 Campbell, Jr. ..... B25D 9/20 173/78
7,694,748 B2 * 4/2010 Oksman ..... E21B 1/38 184/7.3
9,022,138 B2 * 5/2015 Braun ..... F16N 11/08 173/218
2002/0050359 A1 * 5/2002 Eddison ..... E21B 4/14 175/57
2003/0121725 A1 * 7/2003 Ilmarinen ..... B25D 17/26 184/7.4
2004/0244493 A1 * 12/2004 Keskiniva ..... B25D 9/14 73/702
2006/0120892 A1 * 6/2006 Muona ..... F15B 11/165 417/375
2006/0238165 A1 * 10/2006 Moore ..... H02J 7/0016 320/118
2008/0296035 A1 12/2008 Lohmann et al.
2009/0090525 A1 * 4/2009 Juvonen ..... F16K 17/082 173/1
2010/0186975 A1 * 7/2010 Glauning ..... H01M 10/486 173/217
2010/0275676 A1 * 11/2010 King ..... G01L 5/14 73/35.14
2011/0270481 A1 * 11/2011 Koga ..... B60W 10/26 701/50
2011/0304284 A1 * 12/2011 Magali ..... B06B 1/12 318/126
2012/0260647 A1 * 10/2012 Draht ..... B21J 15/025 60/484
2014/0290972 A1 * 10/2014 Robson ..... B25D 9/145 60/415
2015/0298062 A1 * 10/2015 Zhu ..... B01D 61/12 210/103
2016/0129575 A1 * 5/2016 Comarmond ..... B25D 17/11 173/1
2016/0326869 A1 * 11/2016 Duong ..... E21B 47/18
2017/0129088 A1 * 5/2017 Kabiraj ..... B25D 9/26
2018/0066680 A1 * 3/2018 Robson ..... E02D 7/10
2018/0135800 A1 * 5/2018 Moore ..... F16N 7/36
2018/0319000 A1 * 11/2018 Frenken ..... F15B 15/22
2019/0100965 A1 * 4/2019 Orban ..... E21B 28/00
2019/0234793 A1 * 8/2019 Matsuura ..... G01N 3/08
2020/0181978 A1 * 6/2020 Koizumi ..... B25D 9/26
2020/0391368 A1 * 12/2020 Koizumi ..... E21B 1/38
2021/0301594 A1 * 9/2021 Anttila ..... E21C 27/12

FOREIGN PATENT DOCUMENTS

EP 2955319 A1 12/2015
WO 2012168558 A1 12/2012
WO 2012168559 A1 12/2012

* cited by examiner

PERCUSSION DEVICE AND METHOD FOR CONTROLLING THE SAME

RELATED APPLICATION DATA

This application is a § 371 National Stage Application of PCT International Application No. PCT/EP2022/052952 filed Feb. 8, 2022 claiming priority to EP 21156648.4 filed Feb. 11, 2021.

BACKGROUND OF THE INVENTION

The invention relates to a percussion device provided with a percussion piston supported axially movably inside a frame of the percussion device by means of bearings.

The invention further relates to a method of controlling a working cycle of a piston of a percussion device.

Breaking hammers are used to break hard materials, such as rock, concrete, and the like. The breaking hammer comprises a percussion device for generating impact pulses to a breaking tool connectable to the breaking hammer. The percussion device comprises a piston which is arranged axially movably inside a frame of the percussion device. The piston moves in an impact direction and in a return direction and thereby executes a working cycle during the operation of the percussion. The working cycle is controlled by means of valves configured to feed and discharge pressurized hydraulic fluid prevailing in working pressure spaces of the percussion device. However, the known solutions for controlling the working cycle of the piston have shown some drawbacks.

BRIEF DESCRIPTION OF THE INVENTION

An object of the invention is to provide a novel and improved percussion device and a method for controlling its operation.

An idea of the disclosed solution is to control a working cycle of a percussion device under control of a control unit. A hydraulic system of the percussion device comprises one or more feed valves and one or more discharge valves which can be controlled independently to each other and the control can also be steplessly implemented. The control of the valves comprises an overlap control feature wherein the feed and discharge valves may be in the same control state i.e. they may be both open, or alternatively, both closed, at the same time. The percussion device is designed for rock breaking machines and is implemented in such machines in mining and construction sites.

To put it more detailed, the idea of the solution is that the hydraulic percussion device comprises a frame and a piston arranged inside the frame and configured to perform a working cycle comprising reciprocating longitudinal movement of the piston in impact direction and return direction due to pressure of hydraulic fluid fed to a first and second working pressure spaces of the percussion device. There are one or more sensing devices for detecting position of the piston relative to the frame. One or more control units are configured to control one or more feed valves and one or more discharge valves for controlling feeding and discharging of the hydraulic fluid of at least one of the first and second pressure spaces for executing the working cycle in response to the sensing data received from the at least one sensing device and control parameters input to the control unit. The feed and discharge valves are controllable to a closed control state and to an open control state. Further, the control unit is provided with at least one control cycle wherein the mentioned feed and discharge valves are independently controllable. The control cycle comprises at least one overlap control feature wherein the feed and discharge valves are simultaneously in the same control state. Furthermore, the mentioned overlap control feature is steplessly and independently controllable by control signals of the control unit.

An advantage of the disclosed solution is that operation of the working cycle of the percussion device is not limited to fixed timings for closing and opening control valves. Instead, the disclosed control system may take into account different situations and circumstances. In other words, the disclosed control is flexible and adaptive. Further, it is easy to update the control cycle by changing implemented control parameters and updating control software. The disclosed new control principle provides a large variety of different useful implementations and use cases. Furthermore, the disclosed solution is relatively easy to implement in different rock breaking machines.

According to an embodiment, the mentioned overlap control feature comprises a positive overlap control feature wherein the feed valve and the discharge valve are simultaneously closed. The overlap control feature further comprises a negative overlap control feature wherein the feed valve and the discharge valve are simultaneously open. In other words, the positive overlap means that connection to a hydraulic fluid circuit is closed and no hydraulic fluid flows exist between the controlled working pressure space and the hydraulic system. Further, the negative overlap means that free hydraulic fluid flow of the hydraulic circuit is arranged to pass through the working pressure space which is controlled by the feed and discharge valves.

According to an embodiment, the mentioned positive overlap and negative overlap are both steplessly adjustable.

According to an embodiment, the control unit is configured to open the feed valve and the discharge valve simultaneously and to produce a free flow of hydraulic fluid through the at least one of the first and second pressure spaces wherein alternating pressure of hydraulic fluid is implemented during the working cycle of the percussion device.

According to an embodiment, the control unit is configured to detect position of the piston at least in the impact direction and is configured to open the feed valve and the discharge valve and to keep them simultaneously open to prevent continuation of the working cycle of the percussion device in response to detection that the piston has exceeded in the impact direction a predetermined distance limit from an impact point designed for the impact device. In other words, the control unit may protect the percussion device against harmful empty strikes for example when the rock breaking machine is not fed or pressed against the rock with sufficient force.

In this embodiment, the control unit is provided with an idle running prevention feature, which may prevent initiation of the working cycle when the rock breaking machine is not properly forced against the target to be broken, and on the hand, the control device can stop the working cycle during the operation when the piston is moved forward from the designed impact point in the impact direction.

According to an embodiment, the position of the piston is detected by means of on/off-type switches which serve as the mentioned sensing device. The switches may be configured to detect shoulders, edges, grooves or any other discontinuities on the piston.

According to an embodiment, the piston may be provided with a special shoulder, edge or groove which is designed for the detection of the switch or any other type of the sensing device.

According to an embodiment, the sensing device is configured to detect position of the piston continuously and for the entire stroke length during the working cycle.

According to an embodiment, the position of the piston is detected by means of touchless sensing device. The sensing device may be an inductive proximity sensor, optical sensor, electric transmitter/receiver or it may be based on magnetism, laser, radio signals, electromagnetism or any other physical phenomena.

According to an embodiment, the control unit is provided with sensing data on properties of the hydraulic fluid fed from a hydraulic system to the percussion device. The control unit is further provided with limit values for at least one property of the hydraulic fluid. Then the control unit is configured to open the feed valve and the discharge valve and to keep them simultaneously open to prevent continuation of the working cycle of the percussion device in response to detection that at least one of the properties of the hydraulic fluid exceeds the input limit values. In other words, the control unit may be provided with an overload protection feature for protecting the percussion device against overpressures and overflows of the hydraulic fluid fed from the hydraulic system of the basic machine to the rock breaking machine. Alternatively, or in addition to, the control unit may be provided with an under flow and/or pressure protection feature. Then the risk of cavitation may be prevented, for example. A further additional or alternative monitored feature may be the temperature of the hydraulic fluid of the hydraulic system. When too cold or hot pressure fluid is detected, the control unit implements pre-determined control measures for setting the temperature to allowed temperature range.

According to an embodiment, the control unit is provided with a hydraulic warm-up feature wherein the control device is configured to open the feed valve and the discharge valve and to keep them simultaneously open to allow free flow of hydraulic fluid through at least one working pressure space to thereby transferring heat energy from the hydraulic fluid flow to the percussion device. An advantage of the warm-up control feature of control mode is that the rock breaking machine will operate properly when being at first prepared for the use, and further, wearing and damages may be prevented especially when working in cold circumstances.

According to an embodiment, the control unit is provided with a hydraulic warm-up feature wherein the control device is configured to close either the feed valve or the discharge valve wherefore pressure in the hydraulic system increases, warms up and is finally discharged through a pressure relief valve of the working machine to the tank. When the hydraulic fluid of the working machine is warm enough, it is then allowed to flow through the working pressure space. Thus, the control unit opens the feed and discharge valve only when the hydraulic fluid is warm enough. This may be called a two-phase warm-up control mode.

According to an embodiment, the control unit is provided with a blocking feature wherein the control device is configured to close the feed valve and the discharge valve and to keep them simultaneously closed to prevent flow of hydraulic fluid through the at least one controlled working pressure space.

According to an embodiment, the control unit is configured to detect magnitude of rebounds following a strike of the piston to a tool in response to detection data received from the at least one sensing device for detecting position of the piston. Further, the control unit is configured to adjust magnitude of the overlap control feature in response to the detected data on rebounds.

According to an embodiment, the control unit is configured to determine a rebound ratio. The rebound ratio is determined by comparing piston impact velocity in impact direction to piston rebound velocity in return direction. The impact velocity and the rebound velocity can be determined in the control device in response to the position detection data based on the one or more sensors or position sensing means. The control unit may adjust the overlap of the feed valve and the discharge valve by increasing or decreasing the overlap. At a lower end of stroke i.e. where the piston movement turns from the impact direction movement to the return direction movement, the overlap of the valves can be increased when the processed rock is hard, whereby rebound velocity can be decreased and hydraulic energy can be retrieved. When the processed rock material is soft, the overlap adjustment comprises decreasing the overlap of the feed and discharge valves. This is beneficial since the piston movement in the return direction due to the rebound is not restricted by means of the overlap, as is the case in processing hard rock wherein high rebound velocities occur.

According to an embodiment, the control unit is configured to adjust the overlap feature or control by increasing or decreasing duration of the overlap.

According to an embodiment, the control unit is configured to adjust the overlap feature or control by adjusting timing of initiation of the overlap.

According to an embodiment, the impact energy reflected from the rock back to the breaking hammer and causing the rebound is retrieved and stored to at least one pressure accumulator of the rock breaking machine. Then, the feed and discharge valves are both closed and escape of increased pressure of the pressure fluid from the rock breaking machine is prevented.

According to an embodiment, the control unit is configured to determine the above mentioned rebound ratio in response to the detected position data. The control unit may calculate rebound energy of the piston and may determine hardness of the rock in response to the detected data of the rebound. High rebound velocity of the piston in return direction compared to piston velocity in impact direction indicates hard rock whereas low rebound velocity in relation to the impact velocity indicates that the rock is relatively soft. The gathered data on hardness of the rock material may be stored in the control unit, transmitted to one or more external electrical devices and may be utilized in versatile ways. The data on rock material may be used for controlling operation of the percussion device, for preventive maintenance purposes and for ensuring that the used rock breaking machine suits well for the work.

According to an embodiment, the control unit comprises a hydraulic short-circuit feature wherein the control device is configured to open the feed valve and the discharge valve and to keep them simultaneously open at or close to a turning point of the working cycle of the piston where the piston movement turns from a return direction movement to an impact direction movement. In other words, by means of the hydraulic short-circuit feature hydraulic fluid can be directed to a tank whereby over pressure in the controlled working pressure space can be prevented. The feature can be implemented as an overload protecting feature.

According to an embodiment, the control unit comprises a stopping feature wherein the control unit is configured to close the feed valve and the discharge valve and to keep them simultaneously closed at or close to a dead point of the working cycle of the piston where the piston movement turns from a return direction movement to an impact direction movement. In other words, by means of the stopping feature hydraulic fluid to and from the controlled working pressure space can be blocked and this feature can be used for controlling movement length.

According to an embodiment, the control unit is configured to direct substantially constant hydraulic fluid pressure to a first working pressure space for moving the piston in the return direction and is configured to feed and discharge hydraulic fluid pressure to and from the second working pressure space and to thereby control reciprocating movement of the piston during the work cycle. In other words, the percussion device comprises an alternating pressure conditions (high pressure—tank pressure) in the impact direction side of the piston.

According to an embodiment, operational principle of the percussion device differs from the one disclosed in the previous embodiment above. The percussion device may alternatively have alternating high pressure—tank pressure conditions effecting in the return direction movement of the piston, and substantially constant high pressure conditions pushing the piston in the impact direction. A further alternative is a solution wherein alternating pressure conditions high pressure—tank pressure is controlled during the work cycle in According to an embodiment, the feed valve and the discharge valve are both directly electrically controlled and operable on/off-valves. In other words, the disclosed valve arrangement comprises direct electrical control.

According to an embodiment, the feed valve comprises a main feed valve which is controlled by means of pressure signals received from a pilot feed valve Correspondingly, the discharge valve comprises a main discharge valve which is controlled by means of pressure signals received from a pilot discharge valve. Further, the pilot feed valve and the pilot discharge valve are controlled independently by the control unit. In other words, the disclosed valve arrangement implements pilot control system.

According to an embodiment, the solution relates to a method of controlling operation of a hydraulic percussion device. The method comprises detecting position of the piston by means of one or more sensing devices and providing one or more control units with sensing data gathered by the sensing devices. The method further comprises controlling at least one feed valve and at least one discharge valve under control of the control unit and controlling feeding and discharging of hydraulic fluid of at least one of a first and second pressure spaces of a percussion device of a rock breaking machine for executing a working cycle of a piston in response to the received sensing data and control parameters input to the control uni. The feed and discharge valves are both controlled to a closed control state and to an open control state during the work cycle. Further, the feed valve and the discharge valve are controlled independently relative to each other and the control is executed by the control unit during the work cycle. The method further comprises implementing in a control cycle of the mentioned valves at least one overlap control feature, wherein the feed and discharge valves are simultaneously in the same control state i.e. both simultaneously open or both simultaneously closed. The control unit generates control signals for controlling the feed and discharge valves steplessly and independently relative to each other in accordance with the overlap control feature.

According to an embodiment, the solution relates to a hydraulic rock breaking hammer provided with the disclosed percussion device. In other words, the mentioned rock breaking machine is the rock breaking hammer.

According to an embodiment, the solution relates to a hydraulic rock drilling machine provided with the disclosed percussion device. In other words, the mentioned rock breaking machine is the rock drilling machine. The rock drilling machine may be a so called top hammer drilling machine or a down-the-hole (DTH) drilling machine.

The above-disclosed embodiments can be combined to form desired solutions provided with necessary features disclosed.

BRIEF DESCRIPTION OF THE FIGURES

Some embodiments are described in more detail in the accompanying drawings, in which.

For the sake of clarity, the Figures show some embodiments of the disclosed solution in a simplified manner. In the Figures, like reference numerals identify like elements.

DETAILED DESCRIPTION OF SOME EMBODIMENTS

Figure 1:
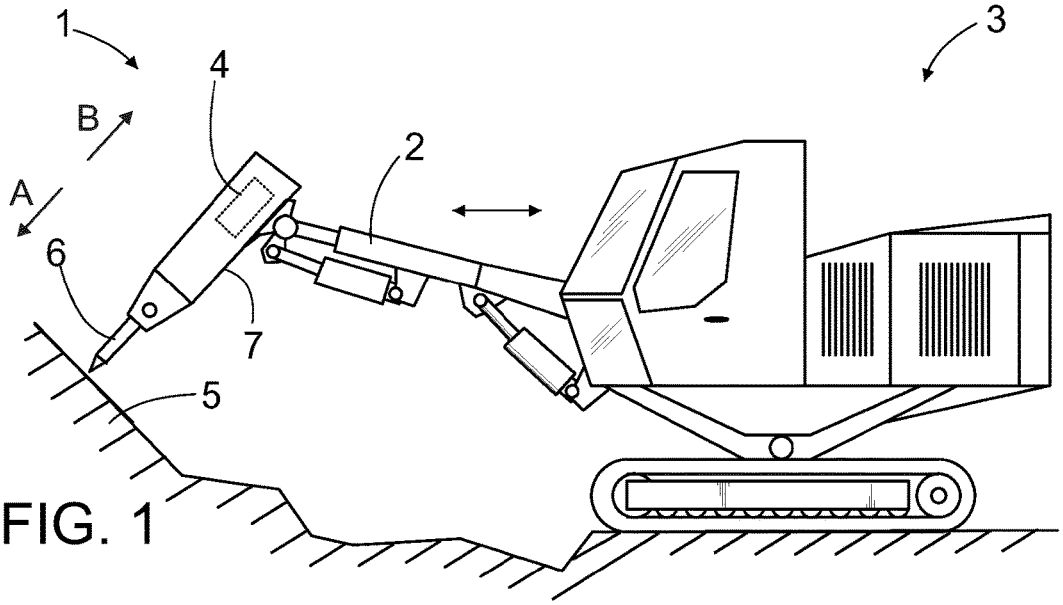
FIG. 1 is a schematic side view of an excavator, which is provided with a breaking hammer.

FIG. 1 shows a breaking hammer 1 arranged on a free end of a boom 2 of a working machine 3, such as an excavator. Alternatively, the boom 2 may be arranged on any movable carriage or on a fixed platform of a crushing apparatus, for example. The breaking hammer 1, which is one type of a rock breaking machine, comprises a percussion device 4 for generating impact pulses. The breaking hammer 1 may be pressed by means of the boom 2 against material 5 to be broken and impacts may be simultaneously generated with the percussion device 4 to a tool 6 connected to the breaking hammer 1. The tool 6 transmits the impact pulses to the material 5 to be broken. The percussion device 4 is hydraulic, whereby it is connected to a hydraulic system of the working machine 2. The impact pulses are generated in the percussion device 4 by means of a percussion piston, that is moved back and forth in the impact direction A and return direction B under the influence of hydraulic fluid. Further, the breaking hammer 1 may comprise a protective casing 7, inside which the percussion device 4 may be located. The percussion device 4 may be in accordance with the solution disclosed in this document.

Figure 2:
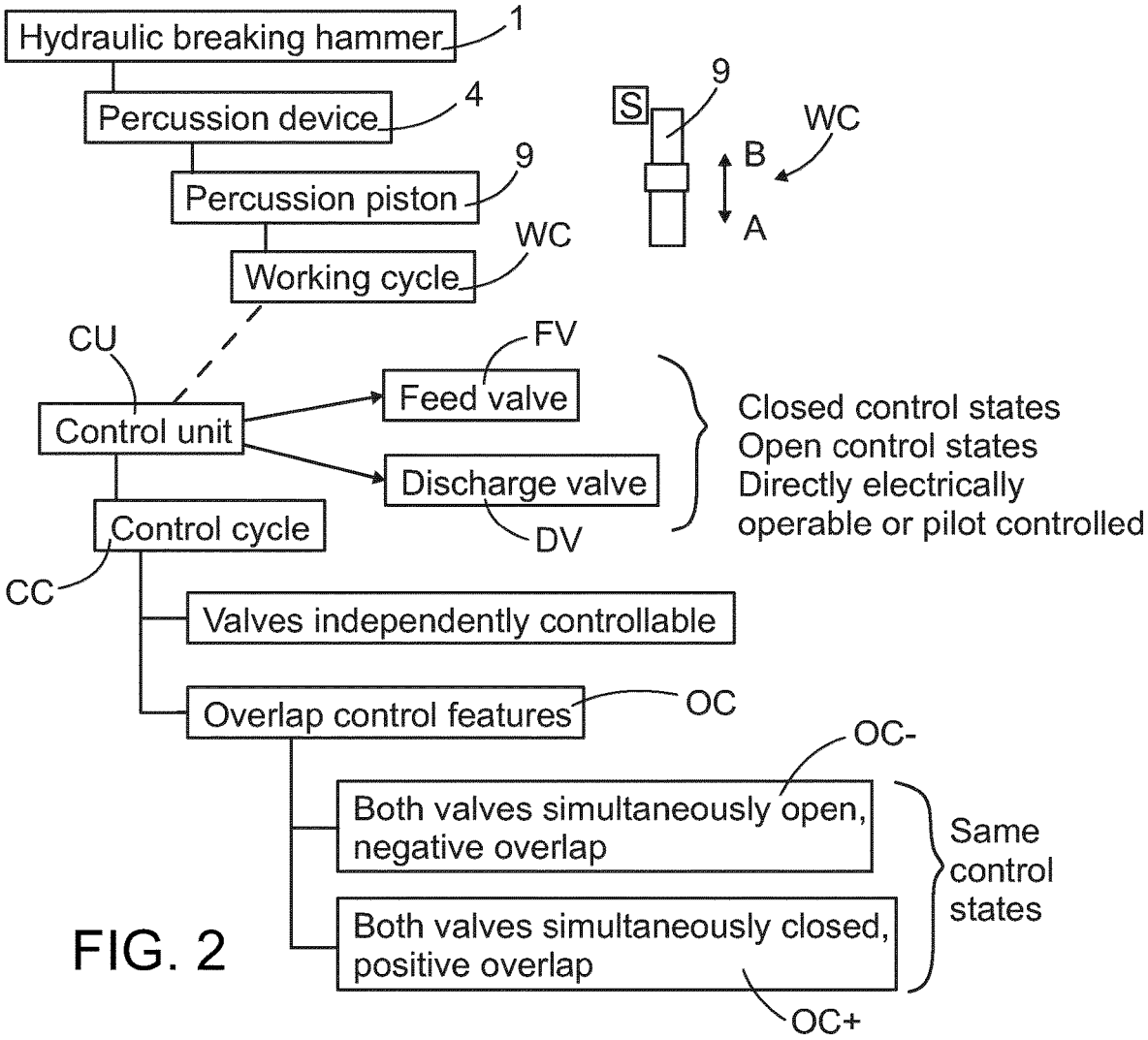
FIG. 2 is a schematic view of a diagram showing some issues relating to the disclosed percussion device and its control features.

FIG. 2 discloses that a percussion piston 9 of a percussion device 4 of a hydraulic breaking device 1 is reciprocated in the impact direction A and return direction B in accordance with a working cycle WC. Movement and position of the piston 9 is detected by means of one or more sensing devices S or sensors. The working cycle WC is controlled by a control unit CU, which is configured to control one or more feed valves FV and one or more discharge valves DV. The feed valve and the discharge valve both comprise two control states: an open control state and a closed control state. The valves can be directly electrically operable valves, or alternatively, they may be pilot controlled valves, as will be disclosed later in FIGS. 3 and 7.

The control unit CU comprises one or more control cycles CC for controlling the valves FV and DV, and for generating needed control signals to change the control states of the valves. Since the valves FV and DV are controlled by the control unit CU and since their control is not restricted by physical limitations or connections, the valves FV and DV are independently controllable to any of their control state. Further, at least one of the control cycles CC of the control unit CU comprises at least one overlap control feature OC. The overlap control OC means that the valves FV and DV are in the same control states: FV open+DV open=negative overlap; and FV closed+DV closed=positive overlap. The control unit CU can select the desired overlap feature OC and can adjust in response to detected sensing data and input control principles.

The features disclosed in FIG. 2 can be implemented in different type of rock drilling machines as well.

Figure 3:
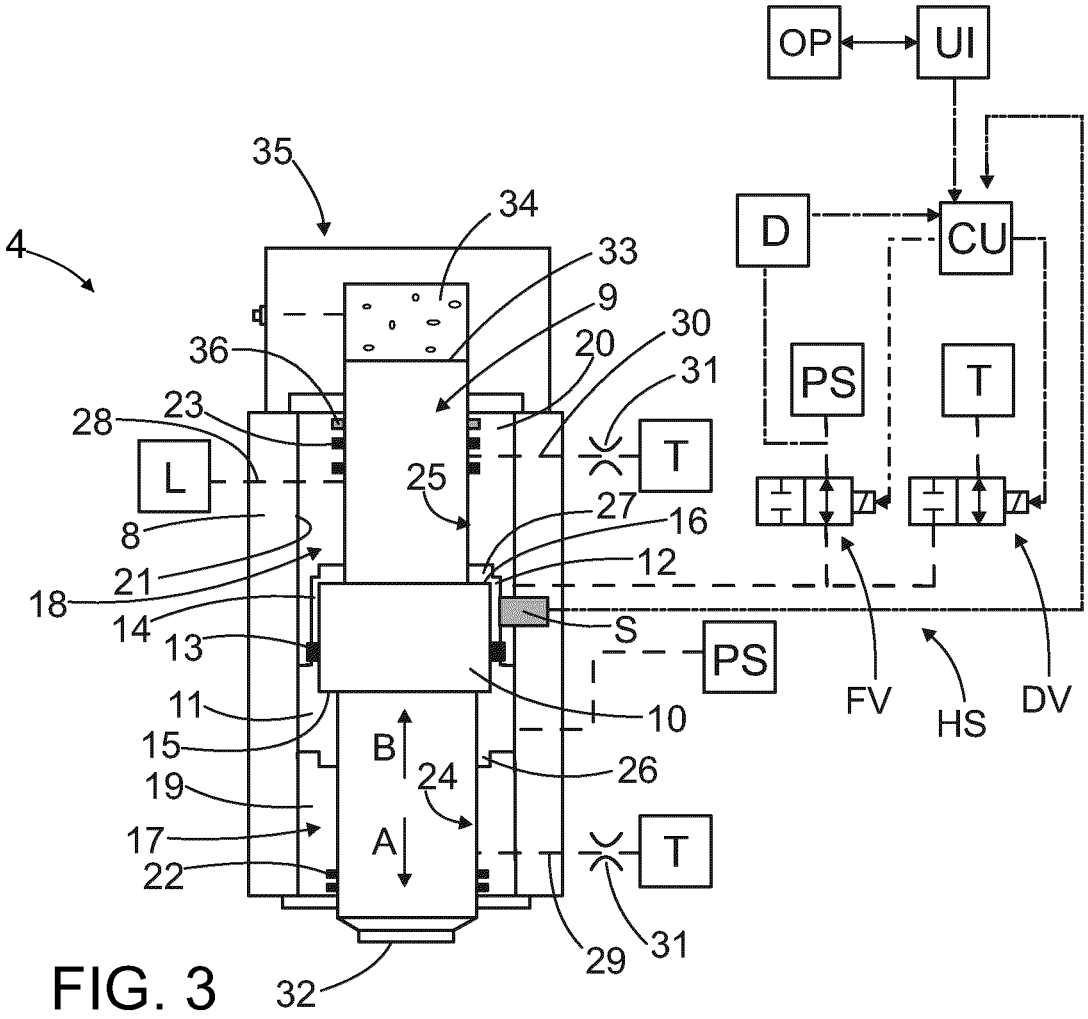
FIG. 3 is a schematic and sectional side view of a hydraulically operated percussion device of a rock breaking machine.

FIG. 3 discloses a basic structure of a percussion device 4 of a rock breaking machine, such as a rock breaking hammer or a rock drilling machine. The percussion device 4 comprises a frame 8 inside which is a percussion piston 9 arranged to be moved in an impact direction A and return direction B. The piston 9 comprises a working collar 10 at its middle section. At the impact direction A side of the collar 10 there is a first working pressure space 11 and at a return direction B side there is a second working pressure space 12 inside which pressure of hydraulic fluid is controlled by means of a control unit CU. The working pressure spaces 11, 12 are separated from each other by means of a collar sealing element 13. A clearance 14 or annular gap surrounds the working collar 10 and this clearance 14 is sealed by the collar sealing element 13.

The piston 9 comprises a first working pressure surface 15 for moving the piston 9 in the return direction B, a second working pressure surface 16 for moving the piston 9 in the impact direction A. The control unit CU may alternate pressure in the second working pressure space 12 by connecting the second pressure space to a tank T or to a pressure source PS. The control unit CU may connect the first working pressure space 11 to the pressure source for the duration of the working cycle. Since effective area of the second working pressure surface 16 is larger than the one of the first working pressure surface 15, the piston moves in the impact direction A when high pressure is fed to the second working pressure space 12. Let it be mentioned that the control of the pressure flows, and the effective areas of the working pressure surfaces may be arranged and dimensioned also in other ways, as it is already mentioned above in this document.

The percussion piston 9 is supported to the frame 8 by means of a first piston bearing 17 and a second piston bearing 18. The first and second piston bearings 17, 18 are separate sleeve-like piston bearing elements 19, 20 which can be mounted axially inside a central through opening 21 of the frame 8. The first piston bearing element 19 provides support for the piston 9 at a lower end portion of the percussion device 4, and the second piston bearing element 20 provides support at the upper end portion. The piston bearing elements 19, 20 or bushings are provided with one or more hydraulic seals 22, 23 for sealing an inner opening diameter of the piston bearings elements 19, 20 to outer diameters of the piston 9. In addition to these seals and a sealing section, the piston bearing elements 19, 20 comprise bearing portions 24, 25 for providing slide bearing for the opposite end portions of the piston 9. The piston bearing elements 19, 20 may also comprise end cushion spaces 26, 27 forming closed pressure spaces with the working pressure surfaces 15, 16 if the piston exceeds its normal stroke lengths in the impact direction A and return direction B. As can be seen, the second working pressure space 12 may be defined between the piston 9 and the second piston bearing element 20. The bearing portion 25 of the second bearing element 20 may be provided with a dedicated lubrication channel 28 for providing lubrication from a lubrication source L for the slide bearing surfaces. Both piston bearing elements 19, 20 may comprise dedicated tank channels 29, 30 provided with throttling devices 31 and connected to the tank T.

The percussion piston 9 comprises an impact surface 32 facing towards the impact direction A and configured to strike a tool. A rear surface 33 of the piston 9 is facing towards the return direction B and is configured to move inside a gas space 34 of a direct acting pressure accumulator 35. At an end portion of a sealing section of the second piston element 20 there is a gas sealing element 36 for separating the bearing portion 25 and the gas space 34 fluid tightly from each other.

Position of the percussion piston 9 can be detected by means of a sensing device S. Gathered sensing data is transmitted to the control unit CU. The control unit CU may also receive sensing data from one or more detecting devices D which may be configured to detect properties of the hydraulic fluid, for example. An operator OP may communicate with the control unit CU via a user interface UI and may thereby input control parameters, control commands and updated computer programs to the control unit CU. The control unit CU is arranged to produce control commands for one or more feed valves FV and one or more discharge valves DV connected to the hydraulic system HS. In FIG. 3 the valves FV and DV are electrically operable control valves and are under direct control of the control unit CU. The valves FV and DV may be simple on/off-type valves. Since large volume flows of hydraulic fluid is typically controlled during the working cycle, it is possible to arrange two or more parallel feed valves FV and two or more parallel discharge valves DV for ensuring fast control measures.

Figure 4:
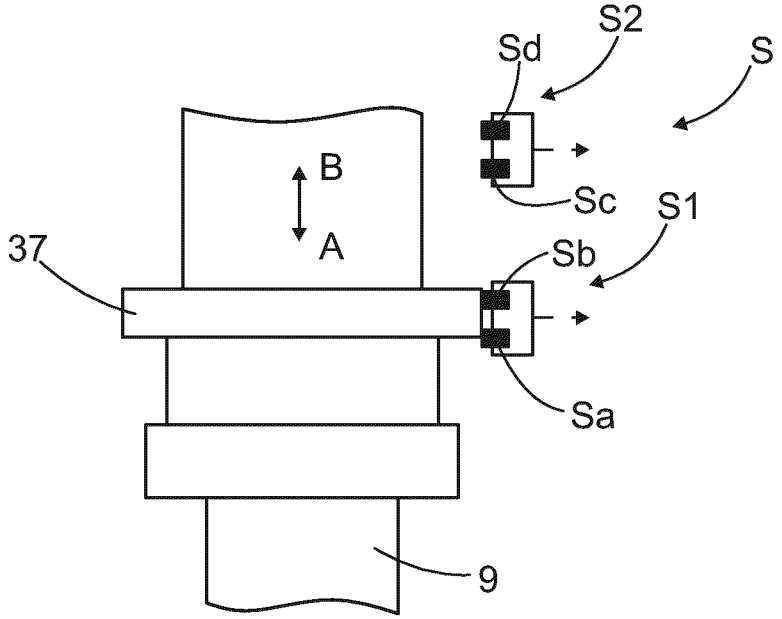
FIG. 4 is a schematic side view of part of a percussion piston and a sensing device configured to monitor its movements.

FIG. 4 discloses a sensing device S which may comprise two sensing units S1 and S2. A first sensing unit S1 may be arranged to monitor a lower dead centre of a piston 9 and may comprise two sensing switches Sa and Sb, whereas a second sensing unit S2 may be arranged to monitor an upper dead centre of the piston and may comprise two sensing switches Sc and Sd. Alternatively, needed timing measures of the control cycle may be calculated in a control unit in response to sensing data received from lower switches Sa, Sb and upper switches Sc, Sd. Use of the simple sensing switches Sa-Sd is advantageous because of their small size, durability and low price, for example.

The piston 9 may be provided with a dedicated sensing collar 37 position of which is detected by means of the sensing device S.

Figure 5:
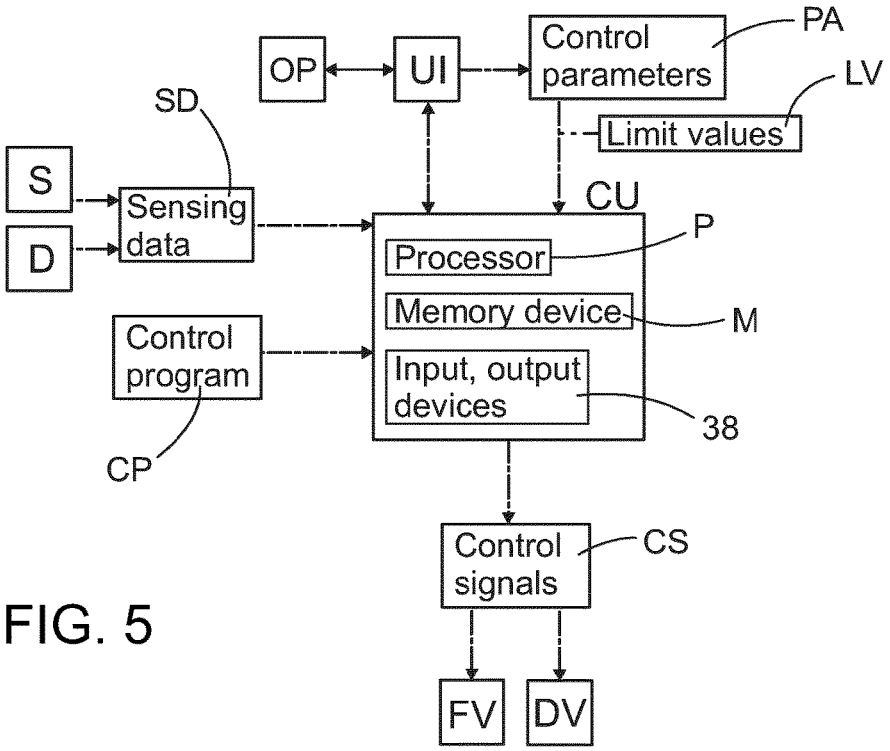
FIG. 5 is a schematic view of some features relating to a control system and control unit of a hydraulic rock breaking machine.

FIG. 5 discloses some features relating to the disclosed control system. A control unit CU comprises one or more processors P, one or more memory devices M and one or more input and output devices 38. One or more control programs CP can be loaded to the control unit CU. The control program CP can be stored to the memory device M and can be processed in the processor P. The control unit CU can receive sensing data SD from the position sensing devices S and the detection devices D. Control parameters PA and different limit values LV can be also be input to the control unit CU.

Figure 6:
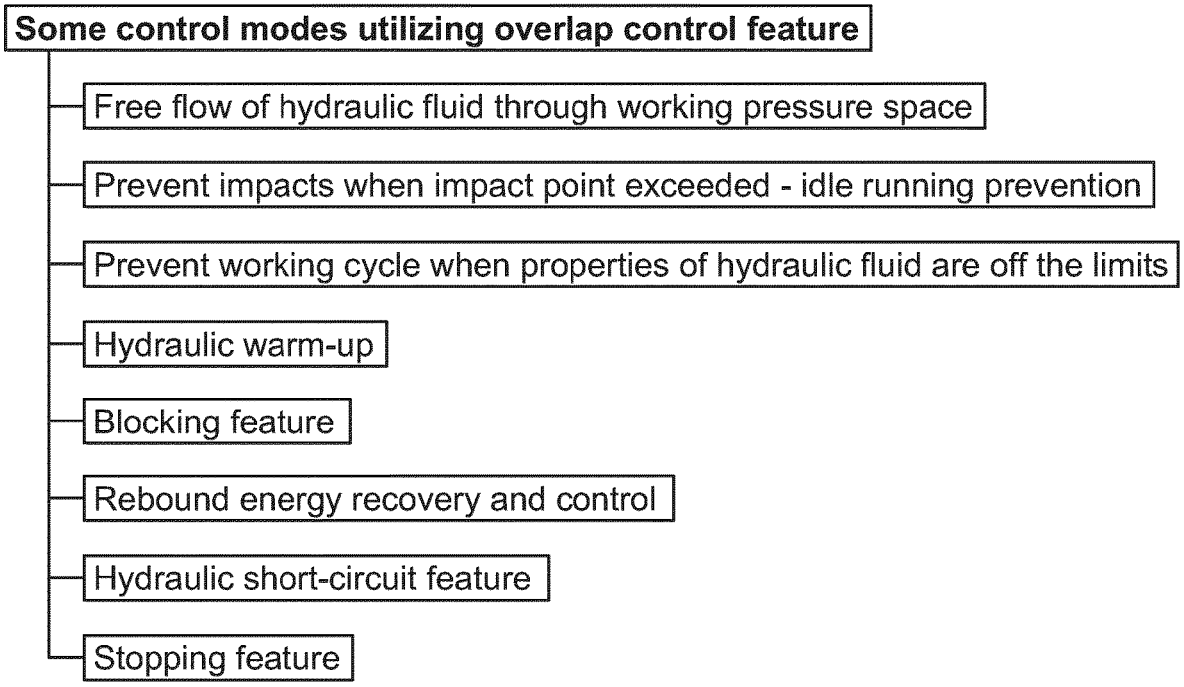
FIG. 6 is a schematic view of a diagram showing some control modes utilizing overlap control features.

FIG. 6 discloses a diagram wherein some possible use cases of the disclosed overlap control feature is listed. These control situations and use cases are already discussed above in this document.

Figure 7:
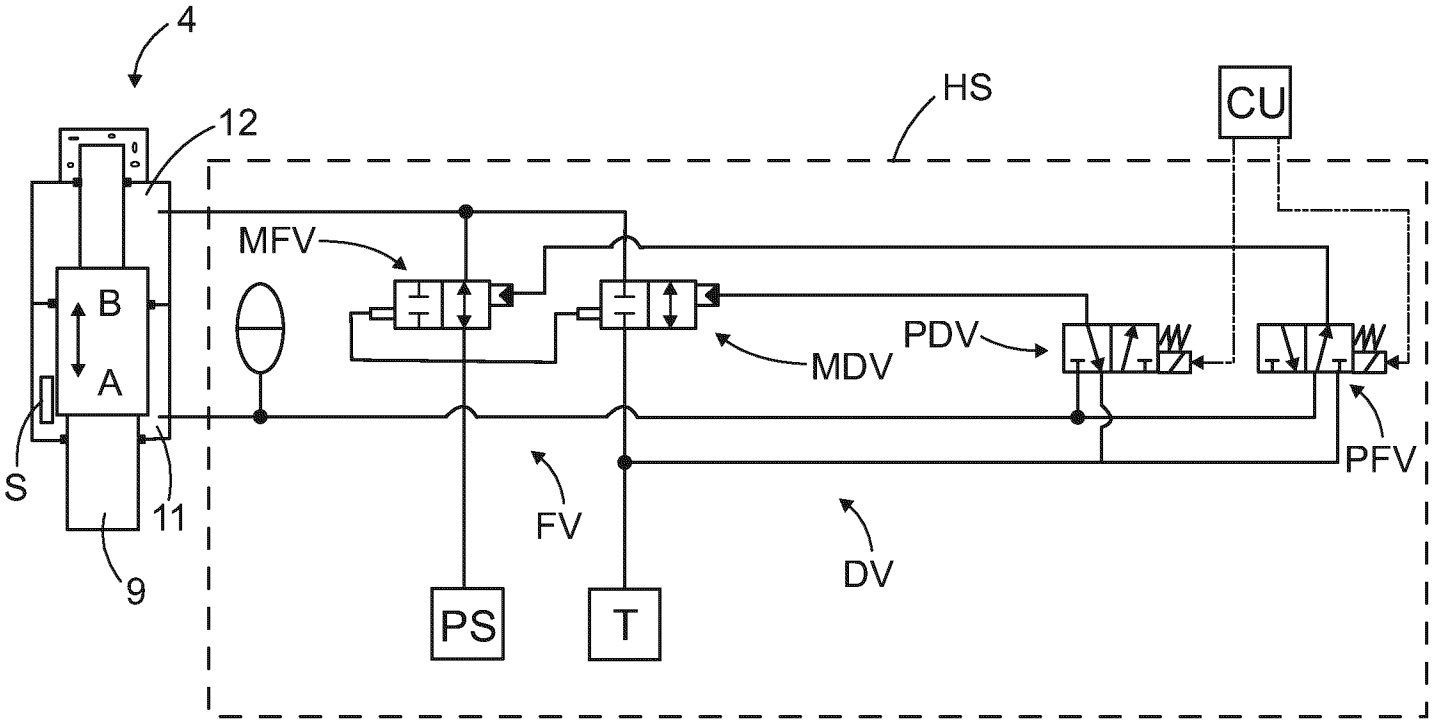
FIG. 7 is a schematic view of a hydraulic percussion device provided with a pilot controlled valve system.

FIG. 7 is a simplified presentation of an alternative to the direct controlled feed and discharge valve system presented in FIG. 3. In this embodiment a hydraulic system HS comprises a main feed valve MFV controlled by a pilot feed valve PFV, and correspondingly a main discharge valve MDV controlled by a pilot discharge valve PDV. The control unit CU generates electrical control for the pilot control valves PFV and PDV, which then provide hydraulic control signals for the main control valves MFV and MDV.

It may also be possible to combine the direct control system disclosed in FIG. 3 and the pilot control system disclosed in FIG. 7 and to thereby provide one valve with direct control and one valve with pilot control, in case it is desired for some reason.

Figure 8:
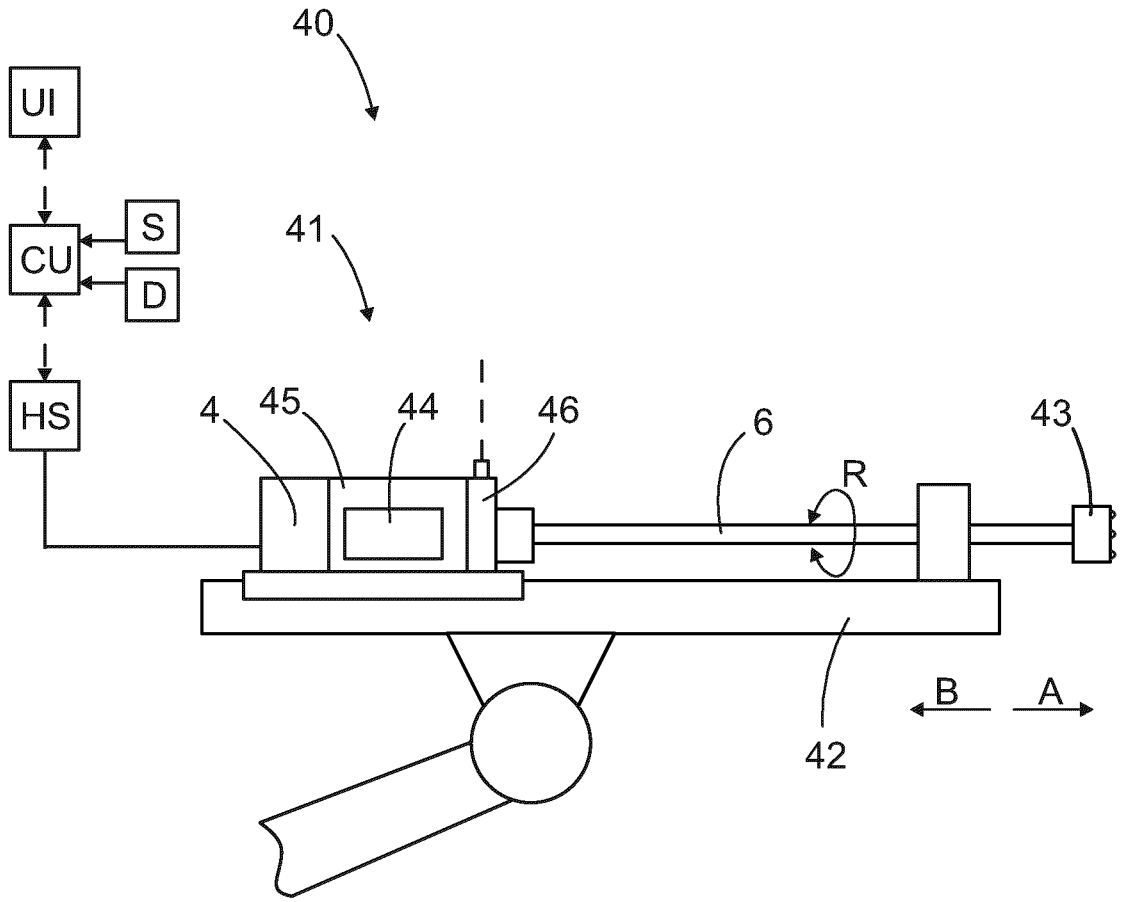
FIG. 8 is a schematic view of a hydraulic rock drilling machine provided with a percussion device which is in accordance with the disclosed solution.

FIG. 8 discloses a rock drilling unit 40 comprising a rock drilling machine 41 arranged movably on a feed beam 42. The rock drilling machine 41 comprises a hydraulic percussion device 4 for generating impact pulses which are transmitted by means of tool 6 to a rock surface. The tool 6 may comprises one or more drilling tubes or rods and a drill bit 43 at its distal end. A rotation device 44 is arranged to turn the tool 6 around its longitudinal axis. At a front end of a body 45 of the rock drilling machine 41 there may be a flushing housing 46 for feeding flushing fluid via the tool 6 to a drilled hole for removing drilling cuttings. The percussion device 4 is connected to a hydraulic system HS comprising control features and components disclosed in this document, and being controlled under control of at least one control unit CU. The control unit CU may communicate with a user interface UI, sensors S and detectors D, and provides required electrical control signals for control valves of the hydraulic system HS in a manner disclosed in this document.

Let it be mentioned that in FIG. 8 a top hammer type drilling machine is disclosed. However, the solution may be implemented also in DTH-type rock drilling machines wherein a percussion device is located at a drill bit side end of a tool.

The drawings and the related description are only intended to illustrate the idea of the invention. In its details, the invention may vary within the scope of the claims.

The invention claimed is:

1. A percussion device comprising:

a frame and a piston arranged inside the frame and configured to perform a working cycle including reciprocating longitudinal movement of the piston in an impact direction and a return direction due to pressure of hydraulic fluid fed to first and second working pressure spaces of the percussion device;

at least one sensing device arranged for detecting a position of the piston relative to the frame;

at least one feed valve arranged for controlling feeding and at least one discharge valve arranged for controlling discharging of the hydraulic fluid of at least one of the first and second pressure spaces; and at least one control unit configured to control the feed valve and the discharge valve for executing the working cycle in response to sensing data received from the at least one sensing device and control parameters input to the control unit, wherein the feed and discharge valves are both controllable to a closed control state and to an open control state, the control unit being provided with at least one control cycle, wherein the feed and discharge valves are independently controllable, wherein the control cycle includes at least one overlap control feature, wherein the feed and discharge valves are simultaneously in the same control state, and wherein the overlap control feature is steplessly and independently controllable by control signals of the control unit, wherein the control unit is configured to determine a rebound ratio by comparing piston impact velocity in the impact direction to a piston rebound velocity in the return direction in response to detected position data received from the at least one sensing device, and wherein the control unit is configured to control the overlap control feature in response to the determined rebound ratio.

2. The percussion device as claimed in claim 1, wherein the overlap control feature comprises:

a positive overlap control feature, wherein the feed valve and the discharge valve are simultaneously closed; and a negative overlap control feature, wherein the feed valve and the discharge valve are simultaneously open.

3. The percussion device as claimed in claim 1, wherein the control unit is configured to open the feed valve and the discharge valve simultaneously and to produce a free flow of hydraulic fluid through the at least one of the first and second working pressure spaces, wherein alternating pressure of hydraulic fluid is implemented during the working cycle of the percussion device.

4. The percussion device as claimed in claim 1, wherein the control unit is configured to detect position of the piston at least in the impact direction and is configured to open the feed valve and the discharge valve and to keep the feed valve and the discharge valve simultaneously open to prevent continuation of the working cycle of the percussion device in response to detection that the piston has exceeded in the impact direction a predetermined distance limit from an impact point designed for the percussion device.

5. The percussion device as claimed in claim 1, wherein the control unit is provided with sensing data on properties of the hydraulic fluid fed from a hydraulic system to the percussion device, wherein the control unit is provided with limit values for at least one property of the hydraulic fluid, and wherein the control unit is configured to open the feed valve and the discharge valve and to keep the feed valve and the discharge valve simultaneously open to prevent continuation of the working cycle of the percussion device in response to detection that at least one of the properties of the hydraulic fluid exceeds the input limit values.

6. The percussion device as claimed in claim 1, wherein the control unit is provided with a hydraulic warm-up feature, wherein the control unit is configured to open the feed valve and the discharge valve and to keep the feed valve and the discharge valve simultaneously open to allow free flow of hydraulic fluid through at least one working pressure space to thereby transferring heat energy from the hydraulic fluid flow to the percussion device.

7. The percussion device as claimed in claim 1, wherein the control unit is provided with a blocking feature wherein the control unit is configured to close the feed valve and the discharge valve and to keep the feed valve and the discharge valve simultaneously closed to prevent flow of hydraulic fluid through the at least one controlled working pressure space.

8. The percussion device as claimed in claim 1, wherein the control unit is configured to detect magnitude of rebounds following a strike of the piston to a tool in response to detection data received from the at least one sensing device for detecting position of the piston; and the control unit is configured to adjust magnitude of the overlap control feature.

9. The percussion device as claimed in in claim 1, wherein the control unit includes a hydraulic short-circuit feature, wherein the control unit is configured to open the feed valve and the discharge valve and to keep the feed valve and the discharge valve simultaneously open at or close to a turning point of the working cycle of the piston where the piston movement turns from a return direction movement to an impact direction movement.

10. The percussion device as claimed in claim 1, wherein the control unit comprises a stopping feature wherein the control unit is configured to close the feed valve and the discharge valve and to keep the feed valve and the discharge valve simultaneously closed at or close to a dead point of the working cycle of the piston where the piston movement turns from a return direction movement to an impact direction movement.

11. The percussion device as claimed in claim 1, wherein the control unit is configured to direct substantially constant hydraulic fluid pressure to a first working pressure space for moving the piston in the return direction and is configured to feed and discharge hydraulic fluid pressure to and from the second working pressure space and to thereby control reciprocating movement of the piston during the work cycle.

12. The percussion device as claimed in claim 1, wherein the feed valve and the discharge valve are both directly electrically controlled and operable on/off valves.

13. The percussion device as claimed in claim 1, wherein the feed valve includes a main feed valve which is controlled by means of pressure signals received from a pilot feed valve, the discharge valve including a main discharge valve which is controlled by means of pressure signals received from a pilot discharge valve, and wherein the pilot feed valve and pilot discharge valve are controlled independently by the control unit.

14. A breaking hammer comprising a hydraulic percussion device in accordance with claim 1.

15. A rock drilling machine comprising a hydraulic percussion device in accordance with claim 1.

* * * * *